US008123422B2

(12) United States Patent
Matsushima et al.

(10) Patent No.: US 8,123,422 B2
(45) Date of Patent: Feb. 28, 2012

(54) IMAGE FORMING APPARATUS AND OPENING/CLOSING METHOD OF RE-CONVEYANCE MECHANISM

(75) Inventors: Toshihiro Matsushima, Mishima (JP); Masataka Muratani, Akishima (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 109 days.

(21) Appl. No.: 12/699,296

(22) Filed: Feb. 3, 2010

(65) Prior Publication Data

US 2010/0178077 A1 Jul. 15, 2010

Related U.S. Application Data

(63) Continuation of application No. 11/676,573, filed on Feb. 20, 2007, now Pat. No. 7,682,096.

(30) Foreign Application Priority Data

Feb. 20, 2006 (JP) ..... 2006-042769
May 16, 2006 (JP) ..... 2006-136775

(51) Int. Cl.
*B41J 3/60* (2006.01)
*B41J 29/02* (2006.01)

(52) U.S. Cl. ..... 400/693; 399/401; 400/188

(58) Field of Classification Search ..... 399/401; 400/188, 693

See application file for complete search history.

(56) References Cited

U.S. PATENT DOCUMENTS 6,830,400 B2 12/2004 Yerg nson
7,246,963 B2 7/2007 Nishimura

FOREIGN PATENT DOCUMENTS

| | | | |
|---|---|---|---|
| JP | 10-003190 | | 1/1998 |
| JP | 10003190 A | * | 1/1998 |
| JP | 2001-002330 | | 1/2001 |
| JP | 2002-207406 | | 7/2002 |
| JP | 2004-123393 | | 4/2004 |
| JP | 2004123393 A | * | 4/2004 |
| JP | 2005-031353 | | 2/2005 |
| JP | 2005-070223 | | 3/2005 |
| JP | 2005-115218 | | 4/2005 |

OTHER PUBLICATIONS

U.S. Office Action dated Mar. 23, 2009 corresponding to U.S. Appl. No. 11/676,573.
Japanese Office Action for Application No. 2006-042769 mailed on Jun. 7, 2011.

* cited by examiner

*Primary Examiner* — Judy Nguyen
*Assistant Examiner* — Jennifer Simmons
(74) *Attorney, Agent, or Firm* — Turocy & Watson, LLP

(57) ABSTRACT

An ADU is turned around a first hole section that operates as fulcrum and opened by a first angle relative to the lateral side of an apparatus main body when dissolving a jam. The lateral side cover is temporarily taken away from a stationary side plate when maintenance the inside of a color copying machine. Then, a second engaging pin is put into a second hole section to engage the lateral side cover with the stationary side plate. The ADU is turned around the second hole section that operates as fulcrum and opened by a second angle greater than the first angle.

14 Claims, 14 Drawing Sheets

IMAGE FORMING APPARATUS AND OPENING/CLOSING METHOD OF RE-CONVEYANCE MECHANISM

CROSS REFERENCE TO RELATED APPLICATION

This application is a Continuation of application Ser. No. 11/676,573 filed Feb. 20, 2007, the entire contents of which is hereby incorporated by reference.

This application is based upon and claims the benefit of priority from prior Japanese Patent Applications No. 2006-42769 filed on Feb. 20, 2006 and No. 2006-136775 filed on May 16, 2006, the entire contents of both of which are incorporated herein by reference.

BACKGROUND OF THE INVENTION

1. Field of the Invention

This invention relates to an image forming apparatus such as a copying machine or a printer that can provide improved maintenance efficiency for the apparatus main body.

2. Description of the Related Art

A conventional image forming apparatus such as copying machines and printers include those equipped with an automatic duplex unit (to be referred to as ADU hereinafter). An ADU operates to feed a sheet bearing a fixed toner image at least on one of the opposite sides thereof feed to the image transfer position of the image forming apparatus once again.

In some image forming apparatus of the type under consideration, the ADU is arranged at a lateral side of the apparatus main body at a position adjacent to the sheet conveyance route in the apparatus main body. With this arrangement, the apparatus main body can be downsized and an ADU can be commonly used in a plurality of image forming apparatus manufactured with different sets of specifications.

With conventionally techniques, when an ADU is arranged at a lateral side of the apparatus main body and a jam accident arises, the ADU is turned around the lower end thereof that operates as fulcrum and then the lateral side of the apparatus main body is opened to dissolve the jam. For example Jpn. Pat. Publication (Kokai) No. 2005-115218, Jpn. Pat. Publication (Kokai) No. 2005-31353 and Jpn. Pat. Publication (Kokai) No. 2001-2330 discloses such techniques.

In some image forming apparatus technology in recent years, the lateral side of the apparatus main body where an ADU is arranged provides an access point for not only dissolve the jam but also maintenance the units in the apparatus main body.

However, in such conventional apparatus, the angle by which the ADU can be turned relative to the apparatus main body is limited to such an extent that the inside of the apparatus main body can be accessed only for dissolving the jam. In this reason, the ADU has to be removed from the apparatus main body when the lateral side of the apparatus main body needs to be opened wide for the purpose of maintenance the units in the inside of the apparatus main body, thus the workability of maintenance could have been went down. In this reason, the ADU and the apparatus main body are linked to each other by wires for driving the sheet feeding rollers and other components. Then, it is a cumbersome operation to find an appropriate location for temporarily put the ADU. Additionally, the wires connecting the apparatus main body and the ADU may be subjected to an undesired load.

Therefore, it is desired for image forming apparatus equipped with an ADU that is arranged at a lateral side of the apparatus main body that the ADU can be turned at a large angle relative to the lateral side of the apparatus main body to improve the maintenance efficiency.

SUMMARY OF THE INVENTION

An aspect of the present invention is to increase the angle by which the ADU is turned so that the corresponding lateral side of the apparatus main body may be opened wide with a simple operation. Then, as a result the inside of the apparatus main body can be accessed with ease to improve the efficiency of maintenance.

According to an embodiment of the present invention, there is provided an image forming apparatus comprising: a re-conveyance mechanism arranged at the lateral side of an apparatus main body so that it can be opened and closed relative to the apparatus main body, for feeding a transfer medium to an image transfer position of the apparatus once again; and an opening/closing mechanism having a first fulcrum for opening/closing the re-conveyance mechanism by a first angle relative to the apparatus main body and a second fulcrum for opening/closing the re-conveyance mechanism by a second angle that is greater than the first angle relative to the apparatus main body.

DETAILED DESCRIPTION OF THE PREFERRED EMBODIMENTS

Figure 1:
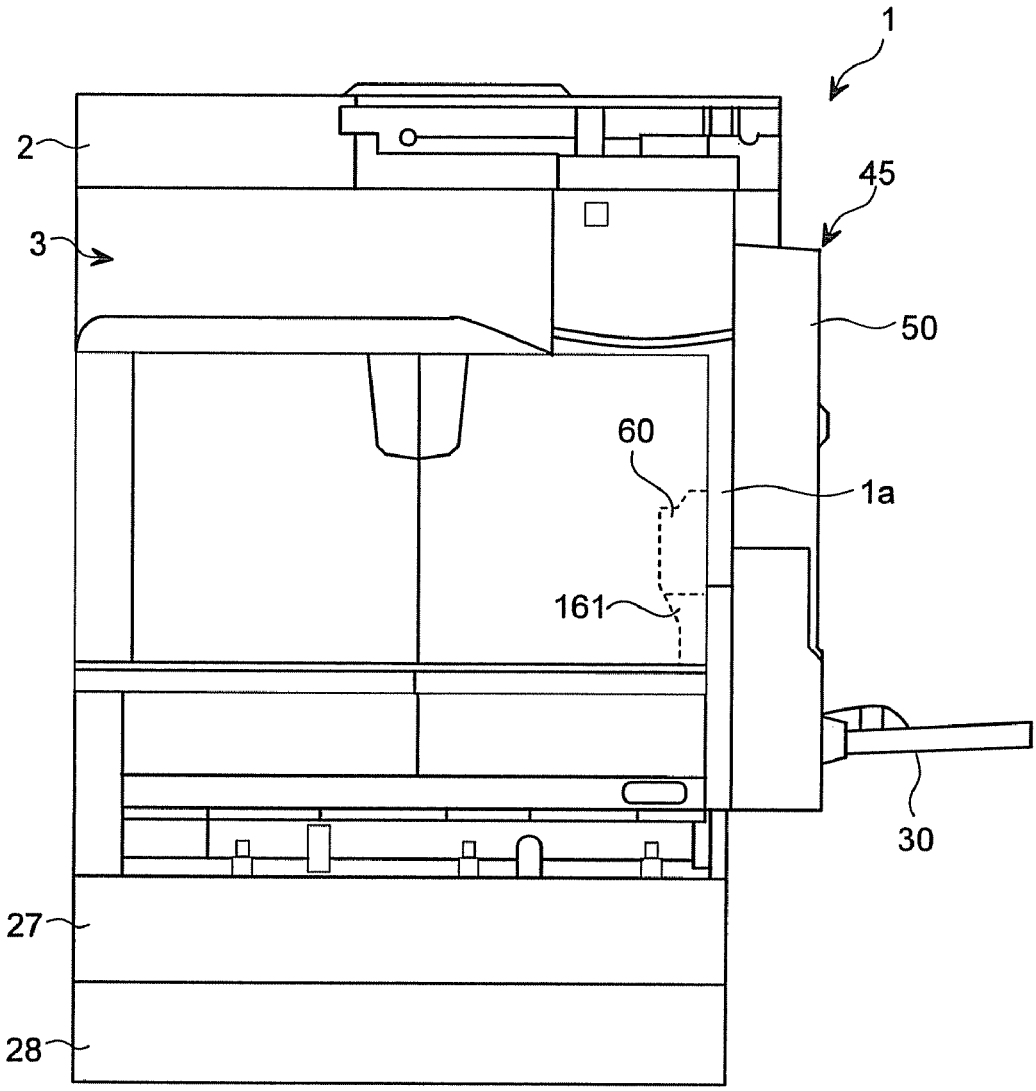
FIG. 1 is a schematic front view of the first embodiment of the present invention, which is a color copying machine.
Figure 2:
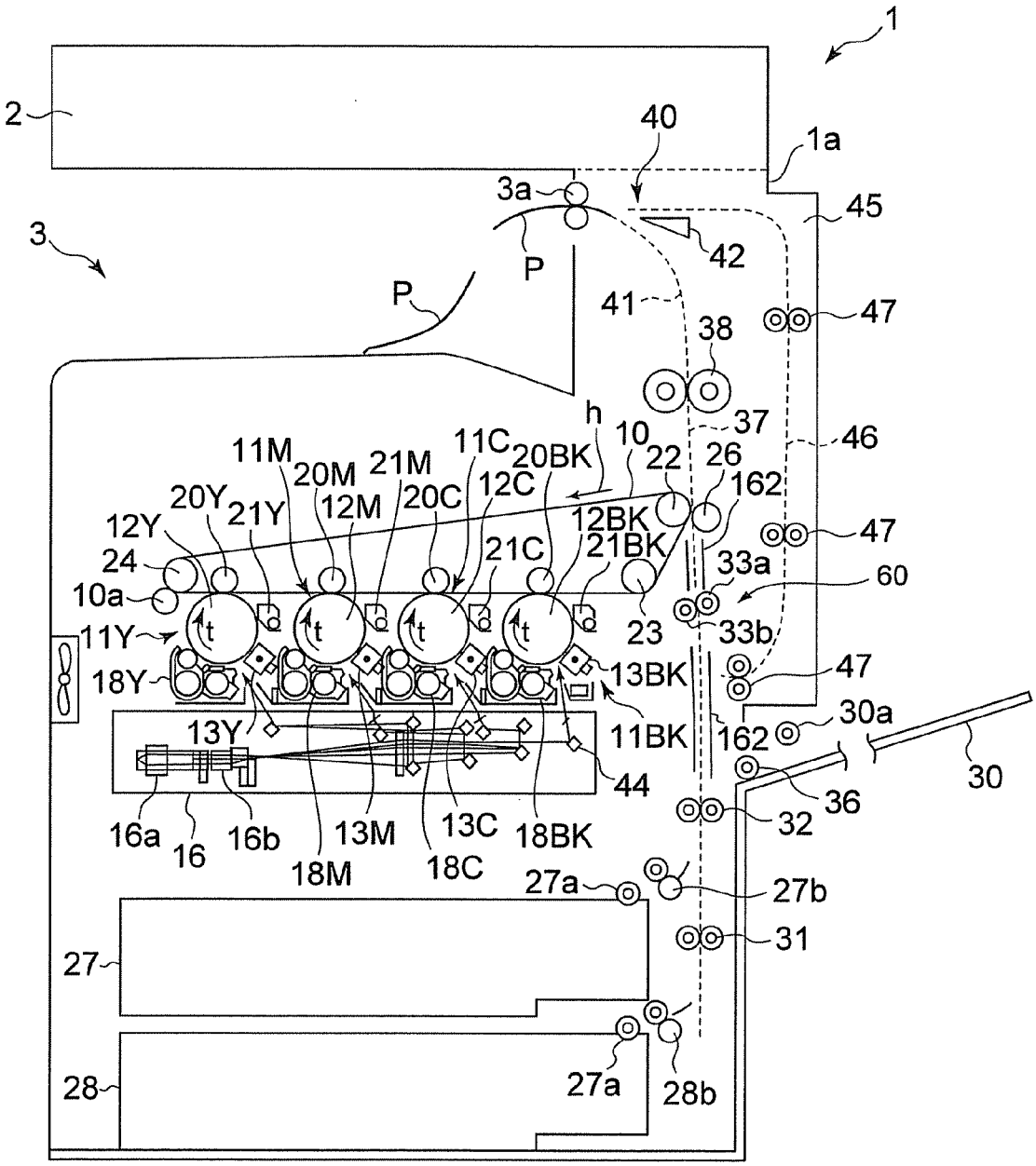
FIG. 2 is a schematic illustration of the color copying machine according to the first embodiment of the present invention, showing the configuration thereof.

Firstly, the first embodiment of the invention will be described in greater detail by referring to the accompanying drawings. FIG. 1 is a schematic front view of image forming apparatus according to the first embodiment of the invention, which is a color copying machine of a four-series tandem system. FIG. 2 is a schematic illustration of the color copying machine 1, showing the configuration thereof. Referring to FIGS. 1 and 2, the color copying machine 1 comprises a scanner section 2 and an intra-body sheet ejecting section 3. The color copying machine 1 also comprises four image forming units 11Y, 11M, 11C and 11K for four colors of yellow (Y), magenta (M), cyan (C) and black (K). The four image forming units 11Y, 11M, 11C and 11K are arranged in parallel relative to each other along and under the intermediate transfer belt 10.

The image forming units 11Y, 11M, 11C and 11K respectively include photosensitive drums 12Y, 12M, 12C and 12K. Electric chargers 13Y, 13M, 13C and 13K, development apparatus 18Y, 18M, 18C and 18K, and photosensitive member cleaning apparatus 21Y, 21M, 21C and 21K are arranged respectively around the photosensitive drums 12Y, 12M, 12C and 12K in the direction of rotation thereof indicated by arrows t. The photosensitive drums 12Y, 12M, 12C and 12K are exposed respectively to laser beams emitted from a laser exposure apparatus 16 in zones from the electric chargers 13Y, 13M, 13C and 13K to the development apparatus 18Y, 18M, 18C and 18K.

For example the electric chargers 13Y, 13M, 13C and 13K electrically uniformly charge the entire surfaces of the respective photosensitive drums 12Y, 12M, 12C and 12K typically to about −700V. The development apparatus 18Y, 18M, 18C and 18K supply the photosensitive drums 12Y, 12M, 12C and 12K with respective two component developers each comprising a toner (of yellow (Y), magenta (M), cyan (C), or black (K)) and a carrier by means of respective development rollers to which a development bias voltage of e.g., about −500V is applied.

The laser exposure apparatus 16 emits laser beams from its semiconductor laser element to scan the respective photosensitive drums 12Y, 12M, 12C and 12K in the axial directions of the photosensitive drums by means of a polygon mirror 16*a*, focusing the laser beams on the photosensitive drums 12BK, 12Y, 12M and 12C by way of a focusing lens system 16*b* and respective mirrors 44.

The intermediate transfer belt 10 is made of, e.g., electrically semi-conductive polyimide that is a stable material from the viewpoint of thermal resistance and abrasion resistance. The intermediate transfer belt 10 is wound around a drive roller 22, a follower roller 24 and a tension roller 23. Primary transfer voltages are applied to the intermediate transfer belt 10 respectively at the positions located vis-à-vis the photosensitive drums 12BK, 12Y, 12M and 12C by means of primary transfer rollers 20Y, 20M, 20C and 20K so that the toner images on the photosensitive drums 12Y, 12M, 12C and 12K are sequentially transferred onto the intermediate transfer belt 10. The photosensitive member cleaning apparatus 21Y, 21M, 21C and 21K recover the residual toners on the photosensitive drums 12Y, 12M, 12C and 12K as waste toner after the primary transfer.

A secondary transfer roller 26 is arranged to face the intermediate transfer belt 10 at secondary transfer position as an image transfer position where the intermediate transfer belt 10 is supported by the drive roller 22. A sheet of paper P that is a transfer medium is fed to the secondary transfer position from either of first and second sheet feeding cassettes 27, 28 as a transfer medium feeding section respectively. More specifically, the sheet of paper P is taken out from the sheet feeding cassette 27 or 28, which is a sheet feeding section, to first or second pickup roller 27*a* or 28*a*, whichever appropriate. Then, the sheet of paper P is fed to the resist rollers 33*a*, 33*b* by way of first or second separation roller 27*b* or 28*b* and first or second conveyance roller 31 or 32, whichever appropriate. The sheet of paper P is fed to the second transfer position in synchronism with the toner image on the intermediate transfer belt 10 by the resist rollers 33*a*, 33*b*.

For example a secondary transfer voltage of about +1,000V is applied to the intermediate transfer belt 10 from the secondary transfer roller 26 at the secondary transfer position by way of the sheet of paper P. Then, as a result, the toner image on the intermediate transfer belt 10 is transferred onto the sheet of paper P for secondary transfer. A belt cleaner 10*a* is arranged at a position downstream relative to the secondary transfer roller 26 of the intermediate transfer belt 10. The belt cleaner 10*a* recovers the toner remaining on the intermediate transfer belt 10 after the secondary transfer as waste toner.

The color copying machine 1 also comprises a manual feed tray 30 that is a sheet feeding section for feeding a sheet of paper P by manual. A manual feed pickup roller 30*a* and a manual feed separation roller 36 for separating the uppermost sheet of paper P and feeding it are arranged between the manual feed tray 30 and the resist rollers 33*a*, 33*b*.

The sheet of paper P that is taken out from the sheet feeding cassette 27 or 28 or the manual feed tray 30 is then fed along longitudinal conveyance route 37 to fixing apparatus 38 by way of the resist rollers 33*a*, 33*b* and the secondary transfer roller 26. The fixing apparatus 38 fixes the toner image transferred onto the sheet of paper P at the secondary transfer position by means of a heat and press process. A delivery conveyance route 41 and an ejecting roller 3*a* for ejecting the sheet of paper P to the ejecting section 3 are arranged downstream relative to the fixing apparatus 38. The ejecting roller 3*a* can be driven to rotate both forwardly and backwardly.

An automatic duplex unit (to be referred to as ADU hereinafter) 45 as a re-conveyance mechanism is arranged at a lateral side 1*a* of the main body of the color copying machine 1. The ADU 45 feed the sheet of paper P bearing a toner image at least on one of the opposite surfaces thereof that is fixed at the fixing apparatus 38 feed to the position of the secondary transfer roller 26 once again. A reversal area 40 is arranged above the fixing apparatus 38. The sheet of paper P that bears a toner image fixed at the fixing apparatus 38 is reversed in the reversal area 40 and then feed back toward the ADU 45 by the ejecting roller 3*a* that can be driven to forwardly and then backwardly.

The ADU 45 is held by a lateral side cover 50 that can be turned relative to the lateral side 1*a* of the apparatus main body so as to be opened and closed. The ADU 45 has a reverse conveyance guide 46 and a re-conveyance roller 47 for feeding the sheet of paper P toward the secondary transfer roller 26.

A secondary transfer unit (to be referred to as TRU hereinafter) 60 that is a conveyance mechanism is arranged at a position adjacent to the ADU 45 in the color copying machine 1. The TRU 60 includes the secondary transfer roller 26, the resist rollers 33*a*, 33*b*, the secondary conveyance roller 32, which are described above, and a conveyance guide 162 for feeding the sheet of paper P toward the secondary transfer roller 26, all of which are held to a frame 161. The frame 161 is adapted to be turned around a lower part thereof that operates as fulcrum so as to open and close the lateral side 1*a* of the apparatus main body.

Figure 3:
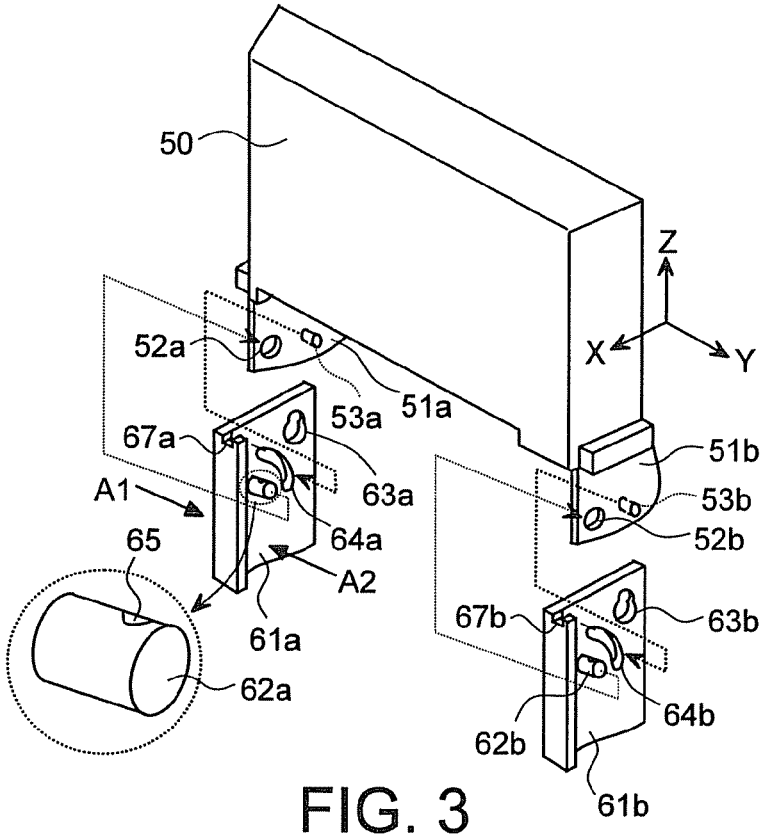
FIG. 3 is a schematic perspective view of the lateral side cover and the support section thereof according to the first embodiment of the present invention, showing the configuration thereof.

Now, the opening/closing mechanism of the lateral side cover 50 will be described below. FIG. 3 schematically illustrates the lateral side cover 50 and the structure of the support section arranged in the apparatus main body of the color copying machine 1 to support the lateral side cover 50. Referring to FIG. 3, stationary side plates 61*a*, 61*b* are rigidly secured to the apparatus main body. The lateral side cover 50 includes movable side support plates 51*a*, 51*b* to be engaged respectively with the stationary side plates 61*a*, and 61*b*. Note that the profiles of the movable side support plates 51*a*, 51*b* and the stationary side plates 61*a*, 61*b* are simplified in FIG. 3.

Figure 4:
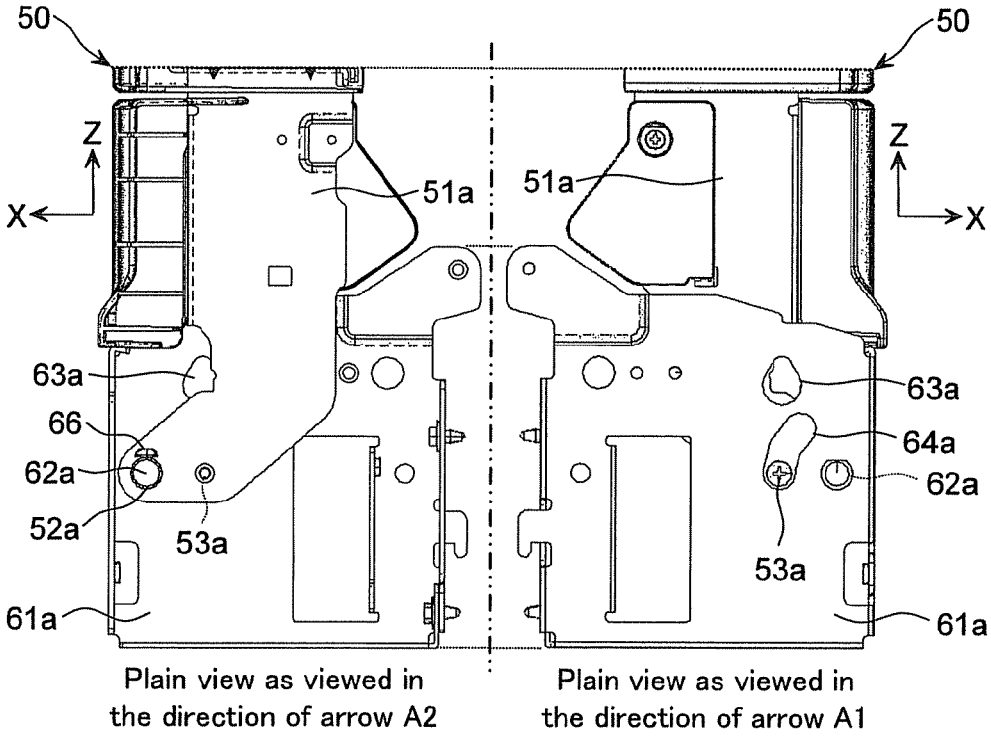
FIG. 4 shows schematic plan views of one of the stationary side plates and the corresponding one of the movable side support plates according to the first embodiment of the present invention as viewed in the respective directions indicated by arrows A1 and A2 in FIG. 3.

FIG. 4 shows schematic plan views of one of the stationary side plates, or the stationary side plate 61*a* and the corresponding one of the movable side support plates, or the movable side support plate 51*a*, as viewed in the respective directions indicated by arrows A1 and A2 in FIG. 3.

The movable side support plates 51*a*, 51*b* respectively include first hole sections 52*a*, 52*b* that operate as first fulcrums and second engaging pins 53*a*, 53*b*. The two movable side support plates 51*a*, 51*b* are structurally identical and the second engaging pins 53*a*, 53*b* are located on a straight line running in parallel with the Y-axis in FIG. 3. So are the first hole sections 52*a*, 52*b*.

The stationary side plates 61*a*, 61*b* respectively include first engaging pins 62*a*, 62*b*, second hole sections 63*a*, 63*b* that operate as second fulcrums and third hole sections 64*a*, 64*b*. The first engaging pin 62*a* is provided with a threaded hole 65. Note that the first engaging pin 62*b* is not provided with any threaded hole. Otherwise, the two stationary side plates 61*a*, 61*b* are structurally identical. The first engaging pins 62*a*, 62*b* are located on a straight line running in parallel with the Y-axis in FIG. 3. So are the second hold sections 63*a*, 63*b* and the third hole sections 64*a*, 64*b*.

The stationary side plates 61*a*, 61*b* respectively include walls sections that are orthogonally bent to the direction of the Y-axis. The wall sections are provided at those areas with respective concave portions 67*a*, 67*b*. When the lateral side cover 50 is turned and inclined, the concave portions 67*a*, 67*b* are engaged respectively with the movable side support plates 51*a*, 51*b* to support the lateral side cover 50.

Referring to FIG. 3, as the lateral side cover 50 is driven to slide in the Y-direction so as to put the first engaging pins 62*a*, 62*b* respectively into the first hole sections 52*a*, 52*b*, the second engaging pins 53*a*, 53*b* are also put into the third hole sections 64*a*, 64*b* respectively.

Then, a screw 66 as a latch is driven into the threaded hole 65 as shown in FIG. 4 while the movable side support plate 51*a* is located closer to the stationary side plate 61*a* than the threaded hole 65 of the first engaging pin 62*a* in the Y-direction, the lateral side cover 50 is blocked by the screw 66 and prevented from sliding in the Y-direction. Thus, the lateral side cover 50 is stably operated for opening/closing around the first engaging pins 62*a*, 62*b* that operate as spindles due to the first hole sections 52*a*, 52*b* operating as fulcrums.

The third hole sections 64*a*, 64*b* respectively guide the second engaging pins 53*a*, 53*b* along the trajectories of movement when the lateral side cover 50 is turned while the first engaging pins 62*a*, 62*b* are put into the first hole sections 52*a*, 52*b* respectively. For this reason, the third hole sections 64*a*, 64*b* shows an arc-shaped contour.

Now the operation of the above-described arrangement will be described below. When the color copying machine 1 is operated normally and a jam arises on the longitudinal conveyance route 37, the lateral side cover 50 has to be opened in order to open the cover that holds the secondary transfer roller 26 and the resist roller 33*a*.

Figure 5:
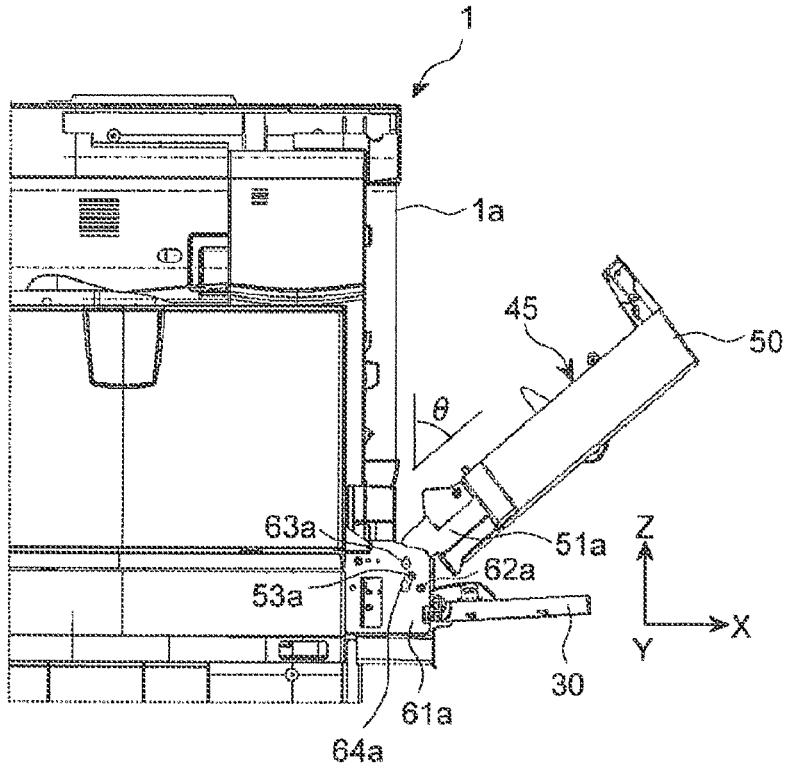
FIG. 5 is a schematic front view of the first embodiment of the present invention, showing how the lateral side cover is opened and closed when dissolving a jam.
Figure 6:
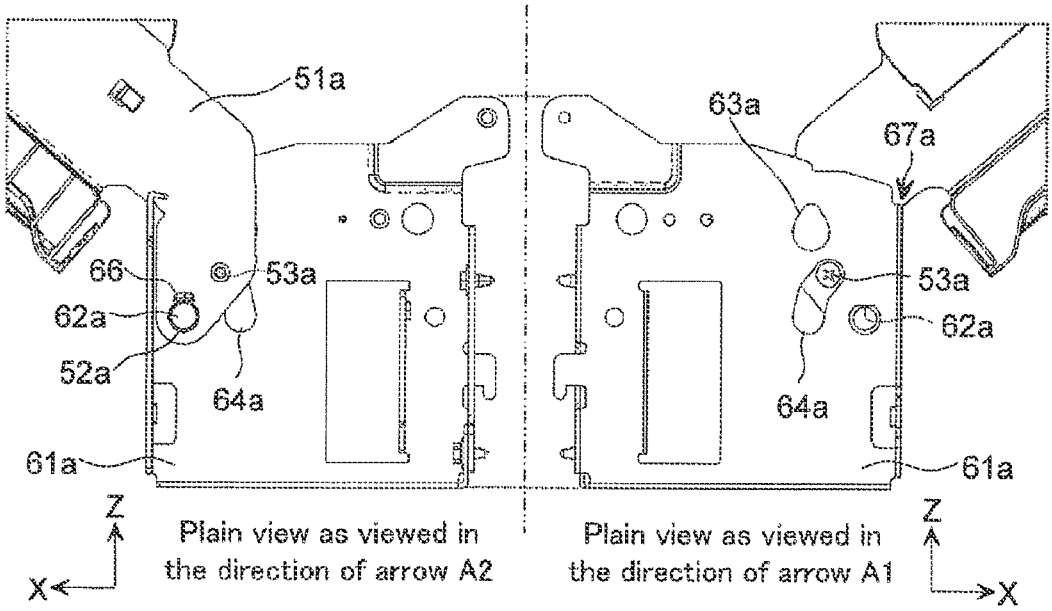
FIG. 6 shows other schematic plan views of one of the stationary side plates and the corresponding one of the movable side support plates according to the first embodiment of the present invention when a jam is to be dissolved as viewed in the respective directions indicated by arrows A1 and A2 in FIG. 3.

FIG. 5 is a schematic plan view of front view of the first embodiment of the invention, showing how the lateral side cover 50 is opened and closed relative to the lateral side 1*a* of the apparatus main body in order to dissolve a jam. Like FIG. 4, FIG. 6 is schematic plan views of one of the stationary side plates, or the stationary side plate 61*a*, and the corresponding one of the movable side support plates, or the movable side support plate 51*a*, when a jam is to be dissolved. As the lateral side cover 50 is opened, the second engaging pins 53*a*, 53*b* remain engaged at the upper ends of the third hole sections 64*a*, 64*b* respectively. The movable side support plates 51*a* 51*b* are engaged respectively with the concave portions 67*a*, 67*b*. As a result, the lateral side cover 50 cannot be inclined beyond a first angle, which is a predetermined opening/closing angle θ1. The opening/closing angle θ1 may be typically between 45° and 55°.

Figure 7:
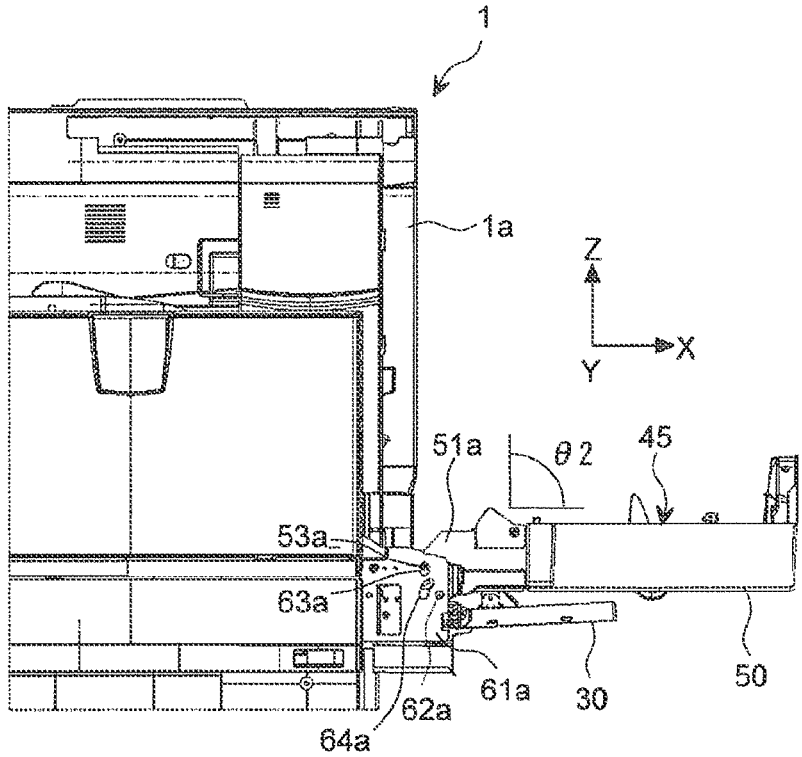
FIG. 7 is a schematic front view of the first embodiment of the present invention, showing how the lateral side cover is opened and closed when maintenance the apparatus.

The operation of the above-described arrangement will be described below in terms of maintenance the inside of the color copying machine 1. The lateral side cover 50 has to be opened wider to allow access to the inside of the color copying machine 1 when the inside of the color copying machine 1 is maintained than when a jam needs to be dissolved in the inside. For example, an opening angle θ2 of the lateral side cover 50 may have to be opened to a second angle, which is 90°, to allow an operator to access the inside of the color copying machine 1 from the lateral side for maintenance. FIG. 7 is a schematic front view of the color copying machine 1, showing the opening angle 82 of the lateral side cover 50 is opened by 90° relative to the lateral side 1*a* of the color copying machine 1. Like FIG. 4, FIG. 8 shows schematic plan views of one of the stationary side plates, or the stationary side plate 61*a*, and the corresponding one of the movable side support plates, or the movable side support plate 51*a*, when the apparatus is maintained.

When the screw 66 is not driven into the threaded hole 65 of the first engaging pin 62*a*, the first engaging pins 62*a*, 62*b* can be disengaged respectively from the first hole sections 52*a* 52*b* while the second engaging pins 53*a*, 53*b* can be disengaged respectively from the third hold sections 64*a*, 64*b* by sliding the lateral side cover 50 in the Y-direction. Therefore, when maintain the inside of the color copying machine 1, the maintenance operator firstly takes out the screw 66, in a state shown in FIGS. 5 and 6. Then, the operator disengages the lateral side cover 50 from the stationary side plates 61*a*, 61*b*, while holding the lateral side cover 50 manually.

Figure 8:
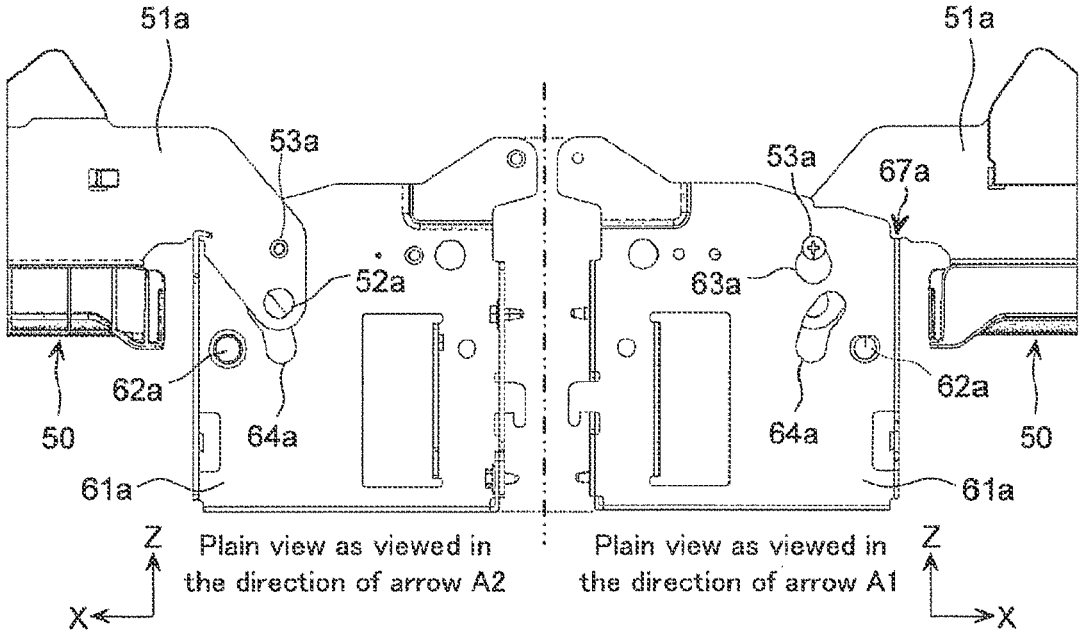
FIG. 8 shows other schematic plan views of one of the stationary side plates and the corresponding one of the movable side support plates according to the first embodiment of the present invention when the apparatus is maintained as viewed in the respective directions indicated by arrows A1 and A2 in FIG. 3.

Subsequently, the operator puts the second engaging pins 53*a*, 53*b* respectively into the second hole sections 63*a*, 63*b* to bring the lateral side cover 50 into engagement with the stationary side plates 61*a*, 61*b* as shown in FIGS. 7 and 8. Thereafter, the operator turns the lateral side cover 50 to further open it until it takes a horizontal position. The lateral side cover 50 is turned around the second engaging pins 53*a*, 53*b* that operate as spindles due to the second hole sections 63*a*, 63*b* operating as fulcrums until it takes a horizontal position. The lateral side cover 50 keeps its horizontal attitude as the movable side support plate 51*a*, 51*b* are respectively engaged with the concave portions 67*a*, 67*b* formed on the stationary side plates 61*a*, 61*b*. Note that the movable side support plates 51*a*, 51*b* do not contact with the first engaging pins 62*a*, 62*b* due to the structure when the lateral side cover 50 is turned while the second engaging pins 53*a*, 53*b* are respectively put into the second hole sections 63*a*, 63*b*.

Thus, with the above-described first embodiment, it is possible to open wide the lateral side cover 50 relative to the lateral side 1*a* of the apparatus main body, by taking out the screw 66 from the first engaging pin 62*a*, sliding the movable side support plates 51*a*, 51*b* in the Y-direction, disengaging the first engaging pins 62*a*, 62*b* respectively from the first hole sections 52*a*, 52*b* and then putting the second engaging pins 53*a*, 53*b* respectively into the second hole sections 63*a*, 63*b*. Then, the operator can easily access the inside of the color copying machine 1 from the lateral side 1*a* of the apparatus main body.

After the maintenance operation, the state of FIG. 4 is restored by reversely following the above-described sequence. More specifically, the operator turns the lateral side cover 50 by a predetermined angle and drives the movable side support plates 51*a*, 51*b* to slide in the Y-direction in order to move them away from the respective stationary side plates 61*a*, 61*a*. Then, as a result, the second engaging pins 53*a*, 53*b* come off from the respective second hole sections 63*a*, 63*b*. Then, the operator puts the first engaging pins 62*a*, 62*b* respectively into the first hole sections 52*a*, 52*b* and also the second engaging pins 53*a*, 53*b* respectively into the third hole sections 64*a*, 64*b*. Additionally, the operator brings the movable side support plates 51*a*, 51*b* closer to the respective stationary side plates 61*a*, 61*b* and drives the screw 66 into the threaded hole 65 of the first engaging pin 62*a*. Thereafter, the operator closes the lateral side cover 50. As a result, the state of FIG. 4 is restored.

With the above-described first embodiment, when a jam arises in the inside of the color copying machine 1 in an ordinary operation, the opening/closing angle of the ADU 45 can be held to the minimal level required to dissolve the jam. When, on the other hand, the color copying machine 1 has to be maintained, the operator can open wide and close the lateral side cover 50 relative to the lateral side 1*a* of the apparatus main body by rearranging the lateral side cover 50 relative to the apparatus main body so as to shift the fulcrums. The rearranging operation is simple and easy. Then, the inside of the color copying machine 1 can be accessed with ease from the lateral side 1*a* of the apparatus main body to improve the efficiency of maintenance.

Figure 9:
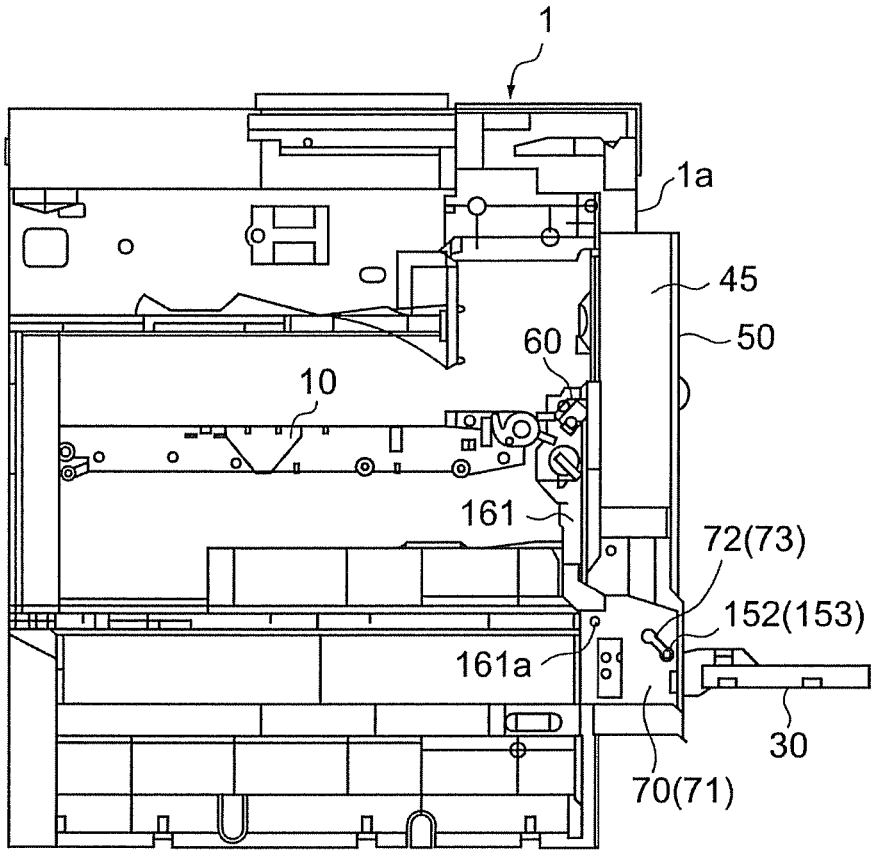
FIG. 9 is a schematic illustration of the second embodiment of the present invention, which is a color copying machine, showing the positional arrangement of an intermediate transfer belt, an ADU and a TRU.
Figure 10:
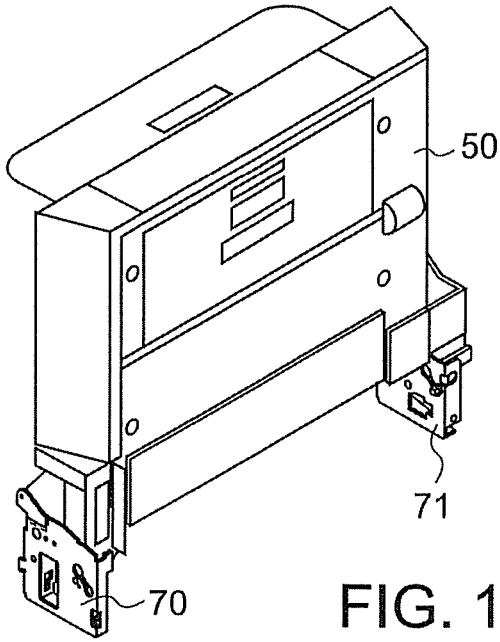
FIG. 10 is a schematic perspective view of the ADU, the front bracket and the rear bracket according to the second embodiment of the present invention.
Figure 11:
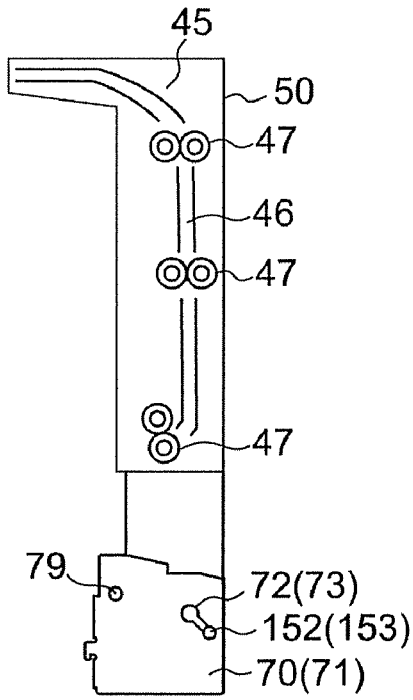
FIG. 11 is a schematic illustration of the ADU and the front bracket according to the second embodiment of the present invention.

Now, the second embodiment of the present invention will be described below. The second embodiment differs from the first embodiment in terms of the mode of moving the ADU unit. Otherwise, the two embodiments are same and identical. Therefore, the components of the second embodiment those are same as their counterparts of the first embodiment are denoted respectively by the same reference symbols and will not be described any further. As shown in FIGS. 9, 10 and 11, the lateral side cover 50 of the ADU 45 of the second embodiment is supported by a front bracket 70 and a rear bracket 71 that are support mechanisms arranged at the lateral side 1*a* of the apparatus main body so that it can be opened and closed relative to the apparatus main body.

Figure 12:
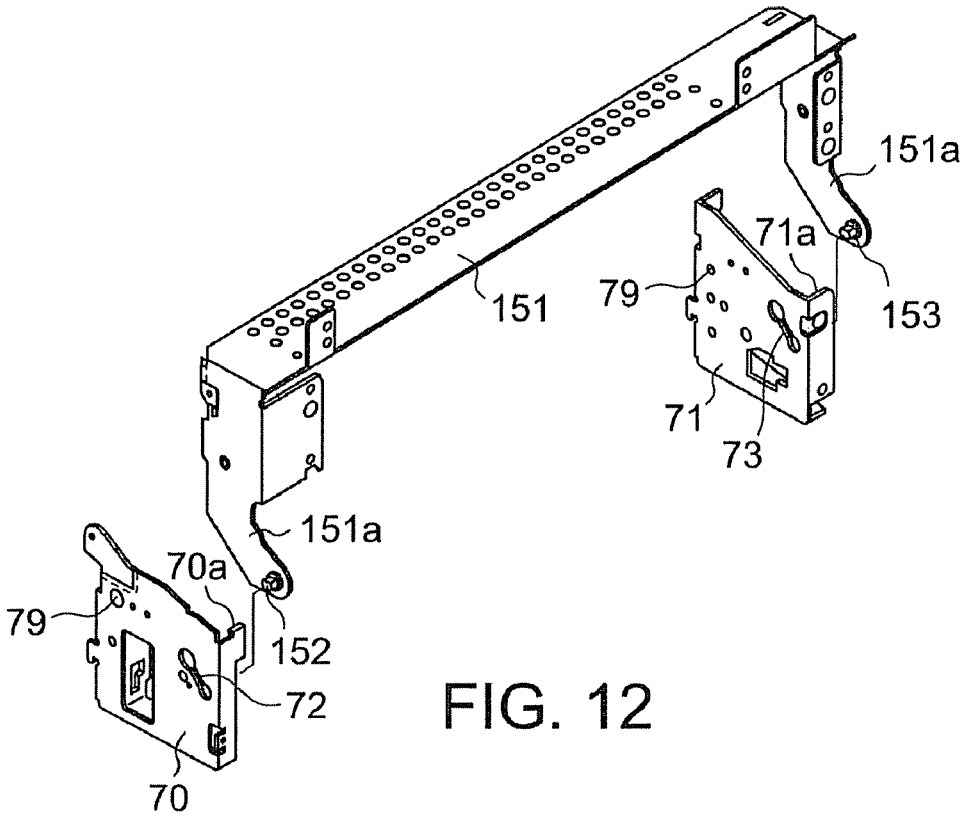
FIG. 12 is an exploded schematic perspective view of the lower frame, the front bracket and the rear bracket according to the second embodiment of the present invention.

As shown in FIG. 12, a front pin 152 and a rear pin 153 are formed as spindles at opposite sides of lower frame 151 of the lateral side cover 50. The front bracket 70 and the rear bracket 71 are provided respectively with front pin supporting hole 72 and a rear pin supporting hole 73.

The lower frame 151 is provided at the opposite sides thereof respectively with concave portions 151*a* adapted to be hit by stopper 70*a* of the front bracket 70 and the stopper 71*a* of the rear bracket 71 to prevent the ADU 45 from turning further.

Figure 13:
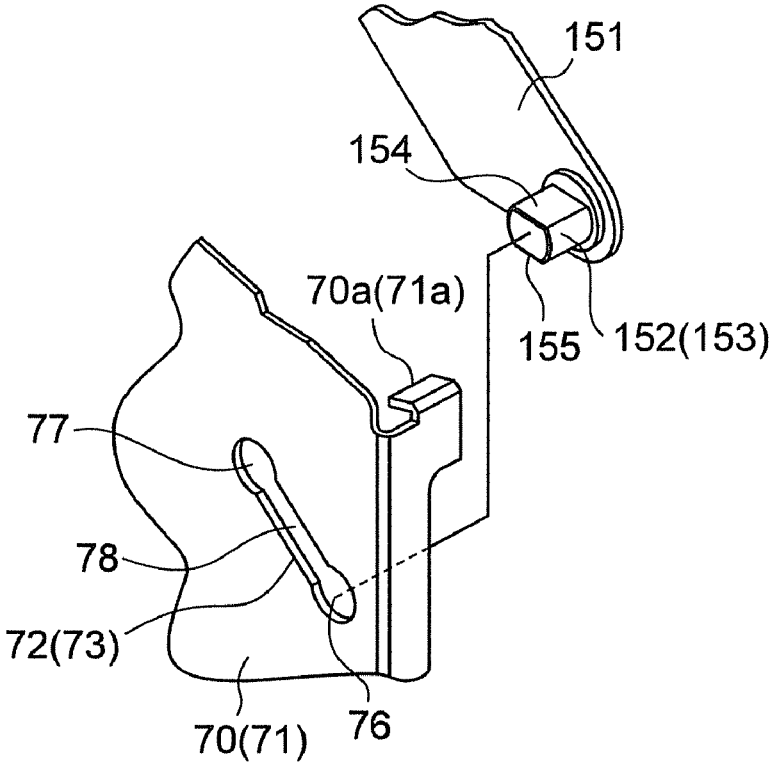
FIG. 13 is an enlarged schematic perspective view of part of FIG. 12 according to the second embodiment of the present invention.

As shown in FIG. 13, both the front pin supporting hole 72 and the rear pin supporting hole 73 have a first hole section 76 that operates as the first fulcrum and the first bearing, a second hole section 77 that operates as the second fulcrum and the second bearing and a slit section 78 as a link section that links the first hole section 76 and the second hole section 77. Both the front pin 152 and the rear pin 53 having a cylindrical profile are cut at opposite sides 154, 155. In other words, both the front pin 152 and the rear pin 153 show an oval cross-section so as to operate as cams.

Figure 14:
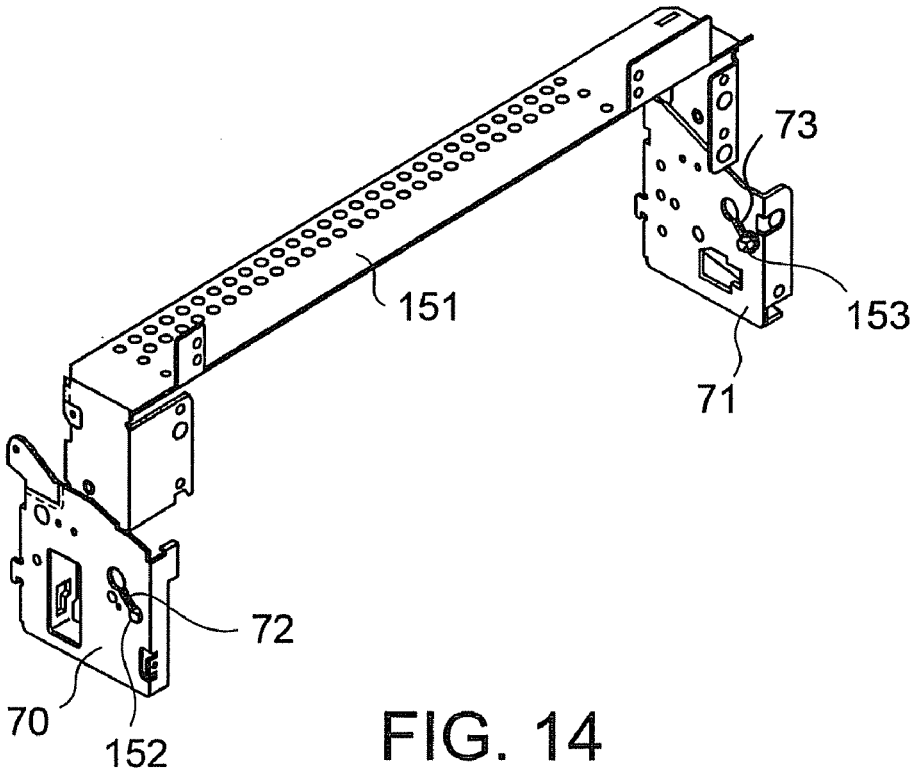
FIG. 14 is a schematic perspective view of the lower frame, the front bracket and the rear bracket according to the second embodiment of the present invention.

As shown in FIG. 14, the front pin 152 and the rear pin 153 are respectively put into the front pin supporting hole 72 and the rear pin supporting hole 73. When the front pin 152 and the rear pin 153 are supported in the respective first hole sections 76, the lateral side cover 50, or the ADU 45, can be opened and closed by an angle of e.g., 50° as the first angle, relative to the lateral side 1*a* of the apparatus main body.

When, on the other hand, the front pin 152 and the rear pin 153 are supported in the respective second hole sections 77, the ADU 45 can be opened and closed by an angle of e.g., 90° as the second angle, relative to the lateral side 1*a* of the apparatus main body.

The slit sections 78 respectively support the front pin 152 and the rear pin 153 so as to allow them slide there when their cut opposite sides 154, 155 run in parallel with the slit sections 78. For example, when ADU 45 is opened by an angle of 35°, the cut opposite sides 154, 155 of the front pin 152 and those of the rear pin 153 of the ADU 45 run in parallel with the slit sections 78. Then, the front pin 152 and the rear pin 153 can be put into the respective slit sections 78.

Figure 15:
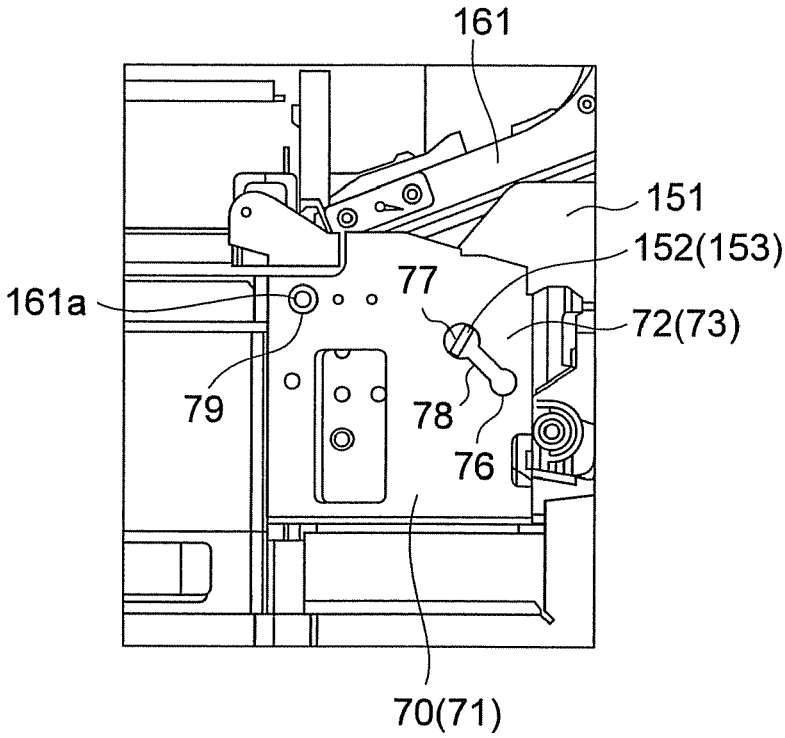
FIG. 15 is a schematic illustration of the pin of the TRU, the front bracket and the rear bracket according to the second embodiment of the present invention.

The frame 161 of the TRU 60 is also supported by the front bracket 70 and the rear bracket 71 so that it may be turned around them to become opened and closed. As shown in FIG. 15, the pins 161*a* arranged at lower lateral sides of the frame 161 are respectively rotatably put into the TRU supporting hole 79 of the front bracket 70 and the TRU supporting hole 79 of the rear bracket 71. The opening angle of the TRU 60 is limited as it interferes with the ADU 45.

Figure 16:
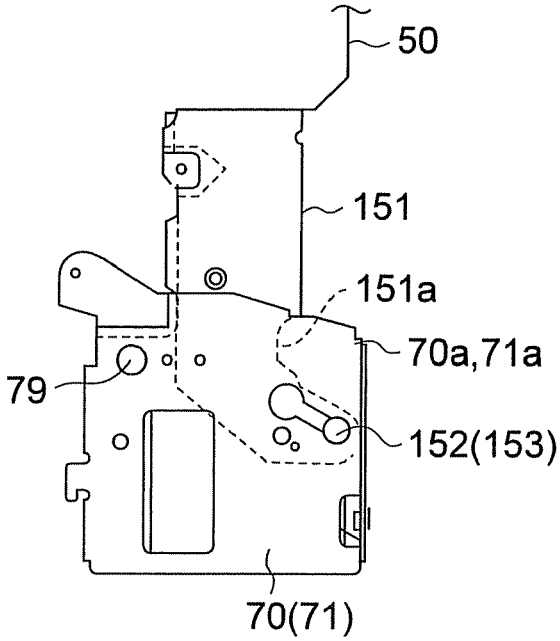
FIG. 16 is a schematic illustration of the lower frame, the front bracket and the rear bracket when the ADU is closed according to the second embodiment of the present invention.

Now, the operation of the second embodiment will be described below. When an image forming process is executed in the color copying machine 1, the front pin 152 and the rear pin 153 of the ADU 45 are supported in the respective first hole sections 76. When the ADU 45 is closed relative to the lateral side 1*a* of the apparatus main body, the concave portions 151*a* of the lower frame 151 of the lateral side cover 50 are separated respectively from the stopper 70*a* of the front bracket 70 and the stopper 71*a* of the rear bracket 71 as shown in FIG. 16.

Figure 17:
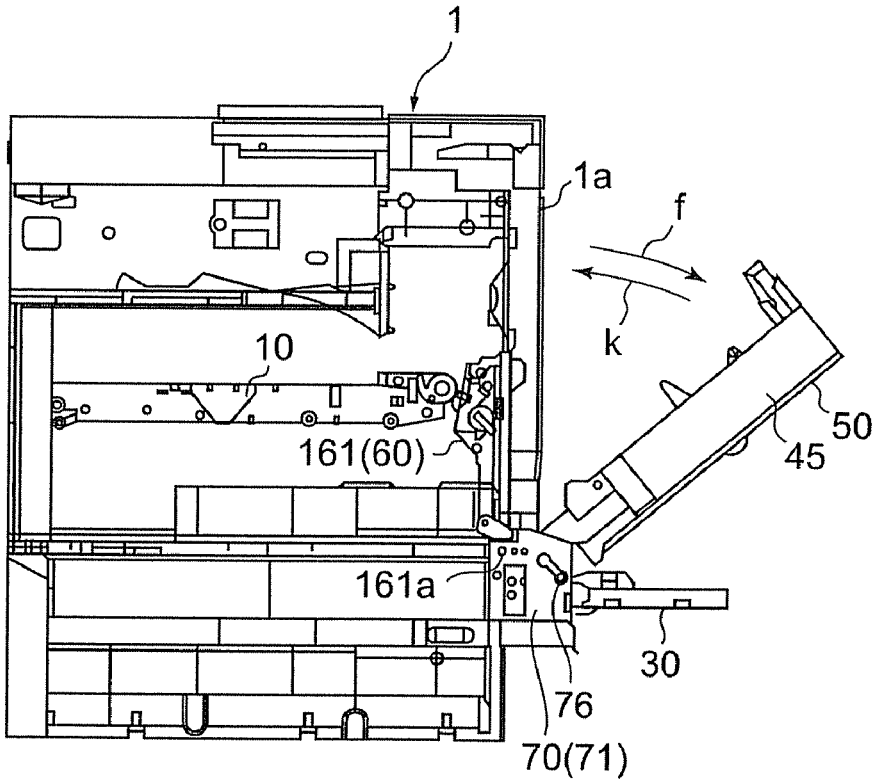
FIG. 17 is a schematic illustration of the second embodiment of the present invention, showing how the ADU is opened to dissolve a jam.
Figure 18:
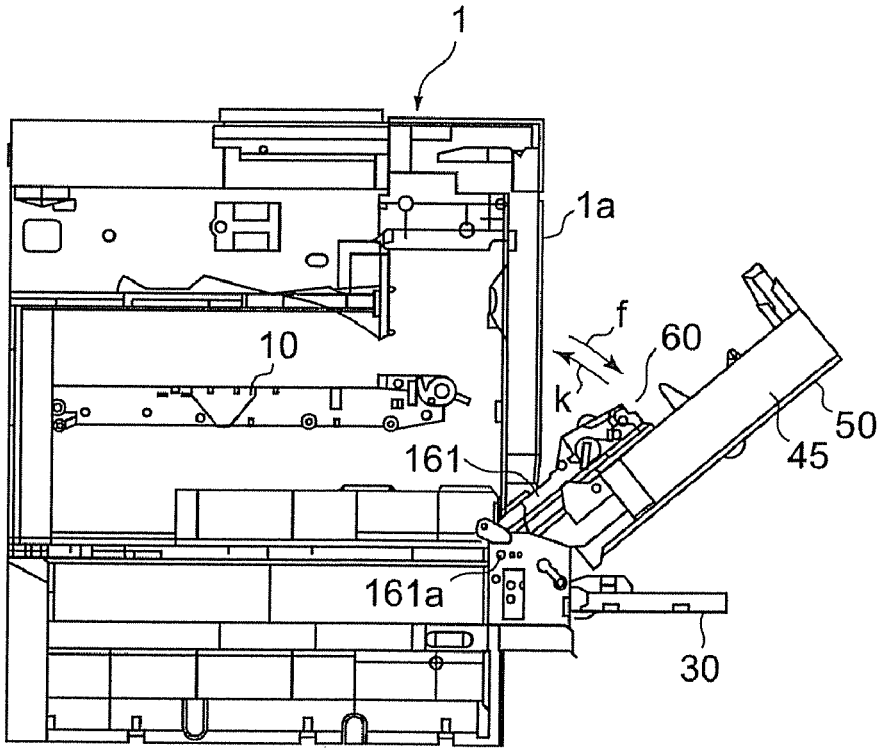
FIG. 18 is a schematic illustration of the second embodiment of the present invention, showing how the TRU is opened to dissolve a jam.
Figure 19:
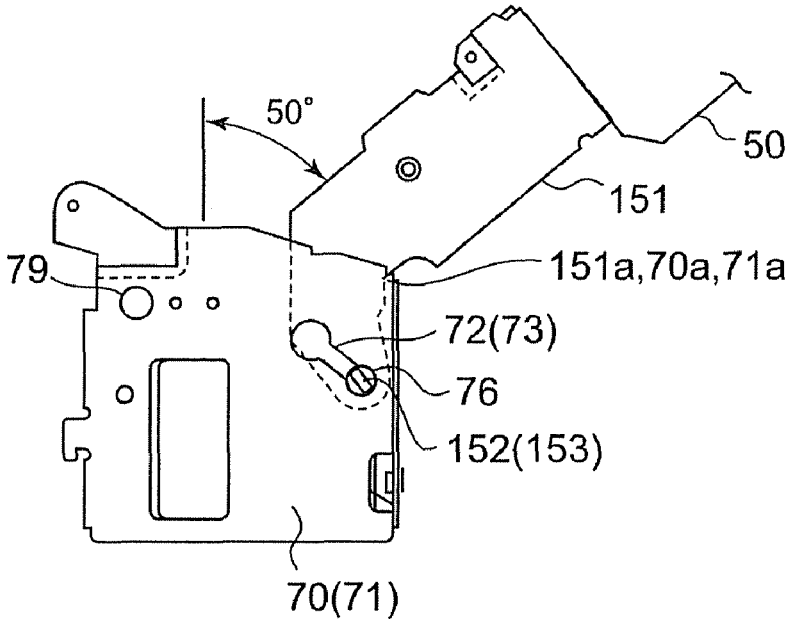
FIG. 19 is a schematic lateral view of the lower frame, the front bracket and the rear bracket when the ADU is opened by 50 degrees according to the second embodiment of the present invention, showing partly as a see through view.

When a jam arises on the longitudinal conveyance route 37 in this condition, the ADU 45 needs to be turned to turn the TRU 60 in order to dissolve the jam as shown in FIGS. 17, 18 and 19. Firstly, the ADU 45 is turned around the front pin 152 and the rear pin 153, which operate as spindles, using the first hole sections 76 as fulcrums, in the direction of arrow f. Then, as the ADU 45 is opened by a turning angle of 50° from the lateral side 1*a* of the apparatus main body as shown in FIG. 19, the concave portions 151*a* of the lower frame 151 of the lateral side cover 50 respectively contact the stopper 70*a* of the front bracket 70 and the stopper 71*a* of the rear bracket 71. As a result, the ADU 45 stops turning.

Thereafter, the TRU 60 is turned in the direction of arrow f. More specifically, the TRU 60 is turned around the pins 161*a* that operate as spindles, using the TRU supporting holes 79 as fulcrums, by about 50° as in the case of the ADU 45. Then, as a result, the frame 161 of the TRU 60 contacts the ADU 45 and the TRU 60 stops turning. Now, the operator can dissolve the jam that takes place in at the conveyance guide 162 or some other position of the longitudinal conveyance route 37 in this condition. After dissolving the jam, the operator turns the TRU 60 in the direction of arrow k to put it back in the main body of the color copying machine 1. Thereafter, the operator turns the ADU 45 also in the direction of arrow k to close the lateral side 1*a* of the apparatus main body. Thus, the color copying machine 1 can reactivate the image forming process. Note that, when a jam takes place in the ADU 45, it can be dissolved only by opening the ADU 45.

Figure 20:
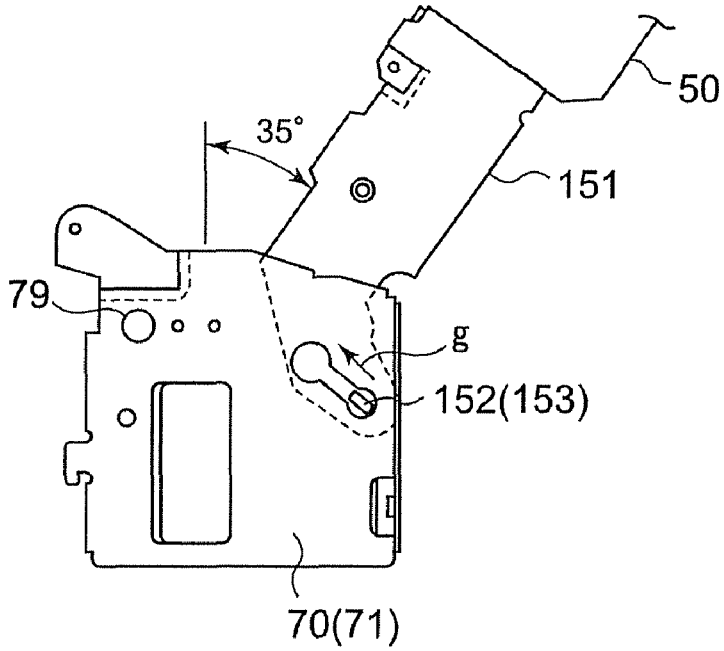
FIG. 20 is a schematic illustration of the ADU according to the second embodiment of the invention, showing how the fulcrum of rotation thereof slides from the first hole section to the second hole section.
Figure 22:
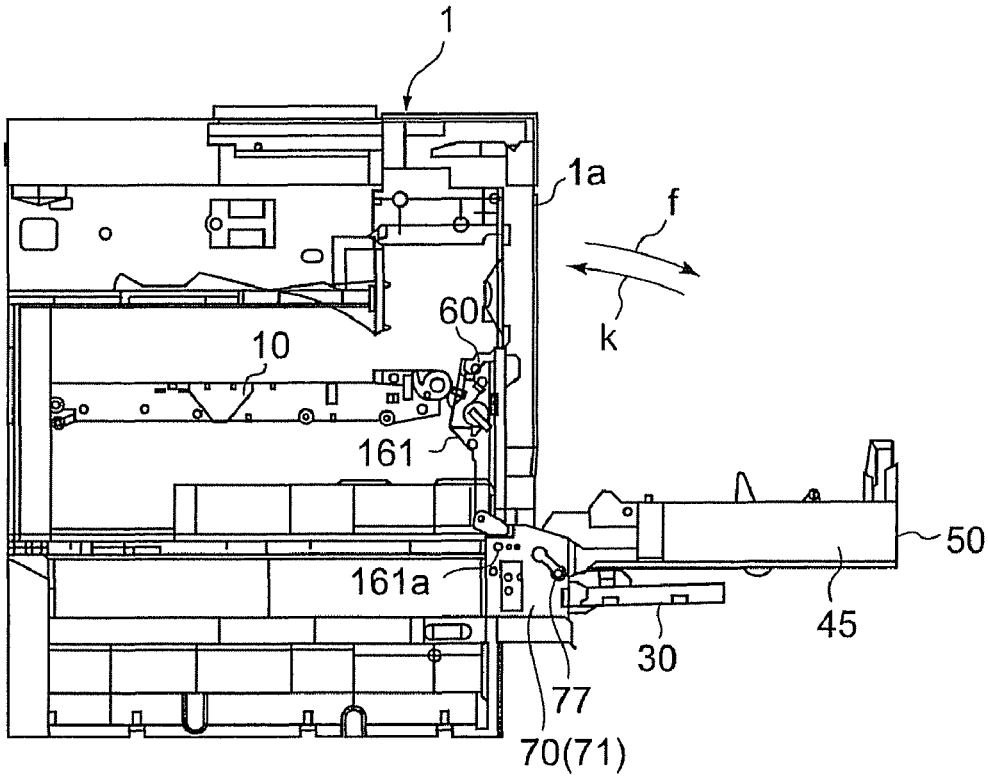
FIG. 22 is a schematic illustration of the second embodiment of the present invention, showing how the ADU is opened when the apparatus is maintained.
Figure 23:
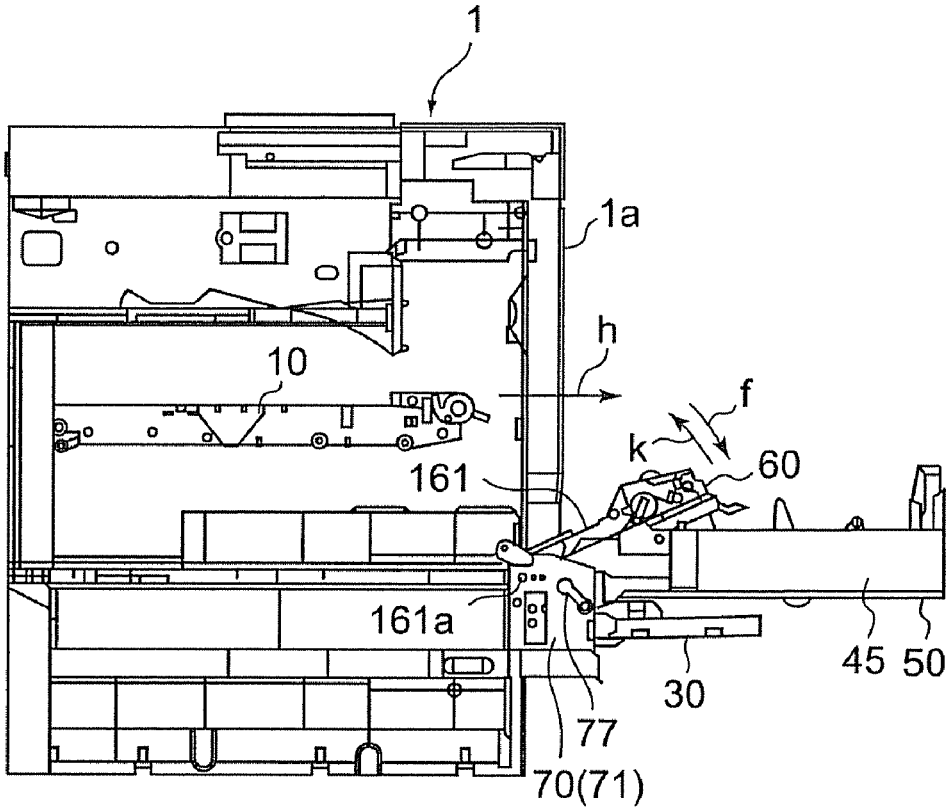
FIG. 23 is a schematic illustration of the second embodiment of the present invention, showing how the TRU is opened when the apparatus is maintained.
Figure 24:
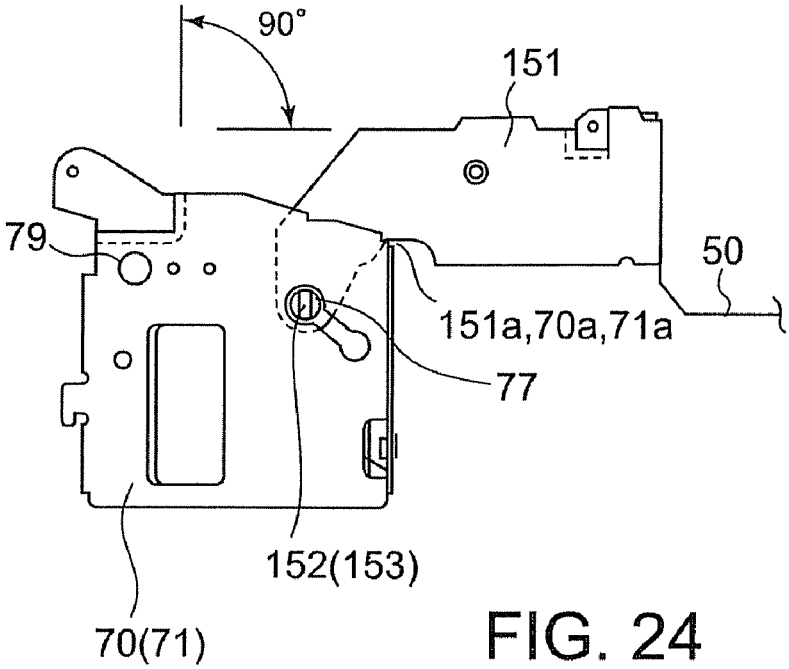
FIG. 24 is a schematic lateral view of the lower frame, the front bracket and the rear bracket when the ADU is opened by 90 degrees according to the second embodiment of the present invention, showing partly as a see through view.

When the inside of the color copying machine 1 is to be maintained, the ADU 45 and the TRU 60 are turned to a larger extent than when a jam is dissolved to open wide the lateral side of the main body 1*a* of the image forming apparatus as shown in FIGS. 22, 23 and 24. Firstly, the ADU 45 is opened by an angle of 35° from the position where it runs in parallel with the lateral side 1*a* of the apparatus main body 1*a* in a condition where the front pin 152 and the rear pin 153 are put into the respective first hole sections 76. As a result, the opposite sides 154, 155 of the front pin 152 and those of the rear pin 153 run in parallel with the slit sections 78. Then, the front pin 152 and the rear pin 153 are put into the respective slit sections 78. Thereafter, the front pin 152 and the rear pin 153 are driven to slide in the direction of arrow g in FIG. 20 along the respective slit sections 78, so as to be put into the second hole section 77 of the front pin 152 and that of the rear pin 152 respectively.

Subsequently, the ADU 45 is further turned around the front pin 152 and the rear pin 153, which operate as spindles, using the second hole sections 77 as fulcrums in the direction of arrow f in FIGS. 22, 23 and 24, in order to open the lateral side 1*a* of the apparatus main body wider. As the ADU 45 is opened by a rotary angle of 90° from the lateral side 1*a* of the apparatus main body, the concave portions 151*a* of the lower frame 151 respectively hit the stopper 70*a* of the front bracket 70 and the stopper 71*a* of the rear bracket 71. As a result, the ADU 45 stops turning. Since the fulcrums for opening/closing the ADU 45 are the second hole sections 77 located at higher positions, the ADU 45 is prevented from interfering with the manual feed tray 30.

Then, the TRU 60 is turned around the pins 161*a*, which operate as spindles, using the TRU supporting holes 79 as fulcrums in the direction of arrow f. As the TRU 60 is turned by about 70° from the lateral side 1*a* of the apparatus main body as shown in FIG. 23, the frame 161 touches the ADU unit 45 so that the latter stops turning. As a result, the lateral side 1*a* of the apparatus main body is opened wide. Subsequently, the intermediate transfer belt 10 in the color copying machine 1 is driven to slide in the direction of arrow h and taken out from the lateral side 1*a* of the apparatus main body for maintenance. If necessary, each of the image forming units 11Y, 11M, 11C and 11BK may be taken out from the lateral side 1*a* of the apparatus main body for maintenance.

Figure 21:
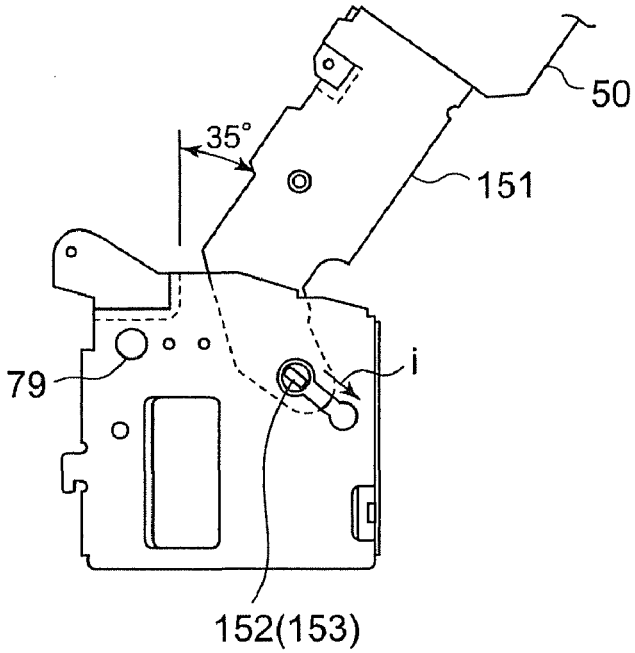
FIG. 21 is a schematic illustration of the ADU according to the second embodiment of the present invention, showing how the fulcrum of rotation thereof slides from the second hole section to the first hole section.

After the completion of the maintenance operation, the TRU 60 is turned in the direction of arrow k and put back into the main body of the color copying machine 1. Then, the ADU 45 is turned in the direction of arrow k and put back to the position with a rotary angle of 35° from the lateral side 1*a* of the apparatus main body. The front pin 152 and the rear pin 153 are put into the respective slit sections 78 at this position. Then, front pin 152 and the rear pin 153 are driven to slide in the respective slit sections 78 in the direction of arrow i in FIG. 21 until the front pin 152 and the rear pin 153 are respectively put into the first hole sections 76.

Thereafter, the ADU 45 is turned further, using the first holes 76 as fulcrums, in the direction of arrow k to close the lateral side 1*a* of the apparatus main body. As a result, the color copying machine 1 is ready for a new image forming process.

When dissolving a jam in the above-described second embodiment, the ADU 45 is opened by a rotary angle of 50°, using the first hole sections 76 as fulcrums, so that consequently the TRU 60 can be opened also by a rotary angle of 50°. When, on the other hand, maintenance the inside of the color copying machine 1, the ADU 45 is opened by a rotary angle of 90°, using the second hole sections 77 as fulcrums, so that consequently the TRU 60 can be opened also by a rotary angel of 70°. Therefore, a small working space is provided to dissolve a jam. Then, it is possible to save space when installing the color copying machine 1 and increase the degree of freedom of installing the color copying machine 1 in terms of the position for installing it. When maintenance the inside of the color copying machine 1, the lateral side 1*a* of the apparatus main body is opened wide so that the intermediate transfer belt 10 and other components in the inside of the color copying machine 1 can be taken out from the lateral side 1*a* of the apparatus main body. In other words, it is possible to increase the degree of freedom of maintenance the color copying machine.

The fulcrums for turning the ADU 45 can be moved from the first hole sections 76 to the second hole sections 77 with ease only by driving the front pin 152 and the rear pin 153 to slide in the respective slit sections 78. Therefore, it is no longer necessary to take out the ADU 45 from the lateral side 1*a* of the apparatus main body and temporarily put it somewhere near the apparatus main body for the purpose of maintenance the inside of the color copying machine 1. Thus, the maintenance efficiency will be remarkably improved.

The present invention is by no means limited to the above-described embodiments, which may be modified and altered in various different ways without departing from the spirit and scope of the present invention. For example, the angle of opening the re-conveyance mechanism is not limited to those described above. The first angle may be appropriately selected to conveniently dissolve jams. The second angle may also be appropriately selected to conveniently take out the intermediate transfer belt and other components from the inside of the apparatus main body for maintenance. The profile of the spindles of the re-conveyance mechanism may be appropriately defined so long as the re-conveyance mechanism can be turned smoothly at the first bearings and the second bearings and the spindles can be driven to slide along the respective link sections.

Figure 25:
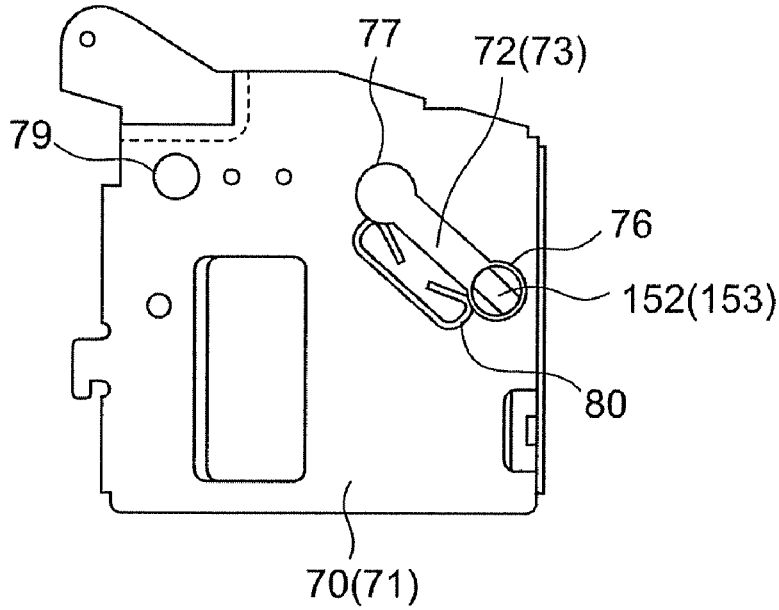
FIG. 25 is a schematic lateral view of a modified embodiment of the present invention, showing the front bracket and the rear bracket holding the front pin and the rear pin at the first hole section.
Figure 26:
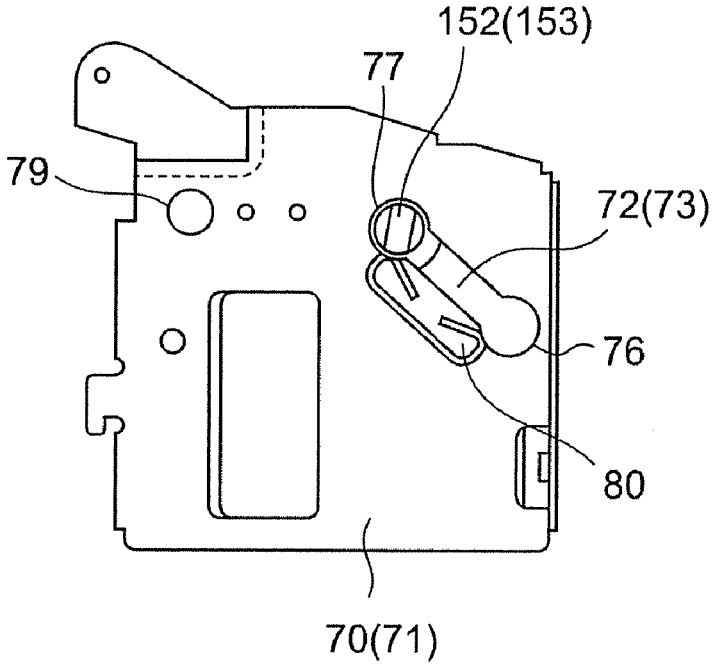
FIG. 26 is a schematic lateral view of a modified embodiment of the present invention, showing the front bracket and the rear bracket holding the front pin and the rear pin at the second hole section.

Additionally, the support mechanisms for supporting the spindles of the re-conveyance mechanism are not limited to those described above particularly in terms of profile and structure. For example, those of the second embodiment may be modified and fulcrum supporting springs 80 may be provided respectively in the front pin supporting hole 72 and the rear pin supporting hole 73 that are formed at the front bracket 70 and the rear bracket 71. Such fulcrum supporting springs 80 operate to reliably hold the front pin 152 and the rear pin 153 in the first hole sections 76 respectively as shown in FIG. 25. Such fulcrum supporting springs 80 also operate to reliably hold the front pin 152 and the rear pin 153 in the second hole sections 77 respectively as shown in FIG. 26. Then, as a result, it is possible to improve the safety of operation when opening/closing the re-conveyance mechanism.

What is claimed is:

1. An image forming apparatus comprising:
- an image forming unit configured to form an image on a medium;
- an apparatus main body configured to support the image forming unit;
- a cover arranged at a lateral side of the apparatus main body to slide between a first position and a second position relative to the apparatus main body; and
- an opening/closing mechanism comprising a first fulcrum to turn the cover at the first position by a first angle and a second fulcrum to turn the cover at the second position by a second angle that is greater than the first angle.

2. The apparatus of claim 1, wherein the opening/closing mechanism includes:
- a spindle arranged at a lower part of the cover to rotate the cover;
- a first bearing arranged at a position of the first fulcrum to support the spindle and to turn the cover by the first angle;
- a second bearing arranged at a position of the second fulcrum to support the spindle and to turn the cover by the second angle greater than the first angle; and
- a link section formed between the first bearing and the second bearing to support the spindle slidably.

3. The apparatus of claim 2, wherein the link section supports the spindle slidably during the cover is opened to a predetermined angle smaller than the first angle.

4. The apparatus of claim 3 wherein the spindle shows a cam-shaped cross section formed by partly cutting a circle and the predetermined angle is an angle at which the cam-shaped spindle can be received in the link section.

5. The apparatus of claim 1, wherein the opening/closing mechanism includes:
- a spindle arranged at a lower part of the cover to rotate the cover; and
- a fulcrum supporting member to support the spindle in the first fulcrum.

6. The apparatus of claim 5, wherein the fulcrum supporting member is an elastic member.

7. An image forming apparatus comprising:
- an image forming unit configured to form an image on a medium;
- an apparatus main body configured to support the image forming unit;
- a cover arranged at a lateral side of the apparatus main body;
- an opening/closing mechanism comprising a first fulcrum to turn the cover at the first position by a first angle and a second fulcrum to turn the cover at the second position by a second angle that is greater than the first angle; and
- a structure arranged adjacent to the cover in the apparatus main body and adapted to be opened and closed around a lower part of the structure and an opening/closing angle of the structure is limited according to the opening/closing angle of the cover.

8. The apparatus of claim 7, wherein the structure is a transfer unit configured to transfer the image on the medium to a sheet.

9. The apparatus of claim 7, wherein the opening/closing mechanism includes:
- a spindle arranged at a lower part of the cover to rotate the cover; and
- a fulcrum supporting member to support the spindle in the first fulcrum.

10. The apparatus of claim 9, wherein the fulcrum supporting member is an elastic member.

11. An image forming apparatus comprising:
- an image forming unit configured to form an image on a medium;
- an apparatus main body configured to support the image forming unit; and
- a cover arranged at a lateral side of the apparatus main body; and
- an opening/closing mechanism comprising:
  - a first engaging pin and a first hole to turn the cover around the first engaging pin by a first angle,
- a second engaging pin and a second hole to turn the cover around the second engaging pin by a second angle greater than the first angle, and
- a latch adapted to engage the first engaging pin to prevent the cover from moving away from the apparatus main body and to detach from the first engaging pin to enable to move the cover between a first fulcrum and a second fulcrum.

12. The apparatus of claim 11, further comprising an arc-shaped hole to limit a trajectory of the second engaging pin during the first engaging pin is in the first hole.

13. The apparatus of claim 11, further comprising a fulcrum supporting member to support the first engaging pin in the first hole.

14. The apparatus of claim 13, wherein the fulcrum supporting member is an elastic member.

* * * * *